US009180471B2

(12) United States Patent
Schlecht et al.

(10) Patent No.: US 9,180,471 B2
(45) Date of Patent: Nov. 10, 2015

(54) TWO-SUBSTANCE NOZZLE AND METHOD FOR SPRAYING A LIQUID-GAS MIXTURE

(71) Applicants: Timo Schlecht, Metzingen (DE); Lars Vater, Pliezhausen (DE); Markus Astfalk, Eningen u.A. (DE)

(72) Inventors: Timo Schlecht, Metzingen (DE); Lars Vater, Pliezhausen (DE); Markus Astfalk, Eningen u.A. (DE)

(73) Assignee: LECHLER GMBH, Metzingen (DE)

( * ) Notice: Subject to any disclaimer, the term of this patent is extended or adjusted under 35 U.S.C. 154(b) by 0 days.

(21) Appl. No.: 14/190,826

(22) Filed: Feb. 26, 2014

(65) Prior Publication Data

US 2014/0239081 A1 Aug. 28, 2014

(30) Foreign Application Priority Data

Feb. 28, 2013 (DE) ..... 10 2013 203 339

(51) Int. Cl.
*B05B 7/10* (2006.01)
*B05B 1/34* (2006.01)

(52) U.S. Cl.
CPC . *B05B 7/10* (2013.01); *B05B 1/341* (2013.01); *B05B 1/3405* (2013.01)

(58) Field of Classification Search
CPC ..... B05B 1/34; B05B 1/3405; B05B 1/341; B05B 1/3415; B05B 1/3421; B05B 1/3431; B05B 1/3447; B05B 7/10
USPC ..... 239/399, 400, 419–419.5, 426–428, 239/432, 433, 434, 463, 469, 474, 475, 482, 239/483, 484, 485, 487, 488, 490, 491–497
See application file for complete search history.

(56) References Cited

U.S. PATENT DOCUMENTS

| | | | | |
|---|---|---|---|---|
| 860,259 | A * | 7/1907 | Smith | 239/399 |
| 1,757,023 | A | 5/1930 | Smith | |
| 1,826,776 | A * | 10/1931 | Gunther | 239/8 |
| 2,249,482 | A | 7/1941 | Macchi | |
| 2,358,386 | A * | 9/1944 | Doll | 239/402 |
| 3,868,061 | A | 2/1975 | Hehl | |
| 5,176,325 | A | 1/1993 | Vidusek | |
| 5,553,785 | A | 9/1996 | Haruch | |
| 5,868,321 | A | 2/1999 | Haruch | |
| 6,705,538 | B2 | 3/2004 | Fecht et al. | |

(Continued)

FOREIGN PATENT DOCUMENTS

| | | |
|---|---|---|
| DE | 2 208 014 A1 | 8/1973 |
| DE | 44 07 780 A1 | 10/1995 |

(Continued)

OTHER PUBLICATIONS

Office Action of German Patent Office issued in German Application No. 10 2013 203 339.7 dated Oct. 29, 2013 (5 pages).

(Continued)

*Primary Examiner* — Christopher Kim
(74) *Attorney, Agent, or Firm* — Flynn, Thiel, Boutell & Tanis, P.C.

(57) ABSTRACT

A two-substance nozzle for spraying a liquid-gas mixture, including a nozzle housing including at least one liquid inlet leading into a mixing chamber and at least one gas inlet leading into the mixing chamber, a swirl insert, an outlet chamber between the swirl insert and an outlet opening on the downstream end of the outlet chamber, wherein a restrictor is provided on the downstream end of the mixing chamber and an intermediate chamber is provided between the restrictor and the swirl insert.

11 Claims, 7 Drawing Sheets

(56) References Cited

U.S. PATENT DOCUMENTS

| | | | |
|---|---|---|---|
| 2002/0134862 | A1 | 9/2002 | Fecht et al. |
| 2003/0146301 | A1 | 8/2003 | Sun et al. |

FOREIGN PATENT DOCUMENTS

| | | | |
|---|---|---|---|
| DE | 195 09 223 | C1 | 11/1996 |
| DE | 100 65 825 | A1 | 7/2002 |
| EP | 0 671 216 | | 9/1995 |
| EP | 1 243 343 | A1 | 9/2002 |
| GB | 180387 | A | 5/1922 |
| GB | 2 096 911 | A | 10/1982 |
| WO | WO 96/21517 | A | 7/1996 |

OTHER PUBLICATIONS

Search Report of European Patent Office issued in European Application No. 14155962.5 with English translation of category of cited documents dated Jun. 25, 2014 (6 pages).

* cited by examiner

TWO-SUBSTANCE NOZZLE AND METHOD FOR SPRAYING A LIQUID-GAS MIXTURE

CROSS-REFERENCE TO RELATED APPLICATION

This application claims the priority of German Application No. 10 2013 203 339.7, filed on Feb. 28, 2013, the disclosure of which is hereby incorporated by reference in its entirety into this application.

FIELD AND BACKGROUND OF THE INVENTION

The invention relates to a two-substance nozzle for spraying a liquid-gas mixture, comprising a nozzle housing including at least one liquid inlet leading into a mixing chamber and at least one gas inlet leading into the mixing chamber, a swirl insert and an outlet chamber between the swirl insert and an outlet opening on the downstream end of the outlet chamber. The invention also relates to a method for spraying a liquid-gas mixture.

SUMMARY OF THE INVENTION

The object of the invention is to provide an improved two-substance nozzle and an improved method for spraying a liquid-gas mixture.

What is provided according to the invention is a two-substance nozzle for spraying a liquid-gas mixture, comprising a nozzle housing including at least one liquid inlet leading into a mixing chamber and including at least one gas inlet leading into the mixing chamber, including a swirl insert, and including an outlet chamber between the swirl insert and an outlet opening on the downstream end of the outlet chamber, with a restrictor on the downstream end of the mixing chamber and an intermediate chamber between the restrictor and the swirl insert being provided.

Surprisingly, providing a restrictor on the downstream end of the mixing chamber and providing an intermediate chamber upstream of the swirl insert allows implementation of a two-substance nozzle which has an essentially constant jet angle of the spray jet output via the outlet opening. Said essentially constant jet angle is maintained during variation of a pressure of the supplied gas and/or a pressure of the supplied liquid. Thereby, the two-substance nozzle according to the invention is capable of providing an essentially constant jet angle during variable or unsteady water pressure, for example. This is particularly important, for example, in case the two-substance nozzle according to the invention is employed for cooling of strands in continuous casting units for long products. The main requirement with secondary cooling in continuous casting units is to effect a controlled, uniform cooling. Such a cooling is performed by means of two-substance spray nozzles. The cooling is to cause solidification of a defect-free casting strand, that is, a flawless strand generally free of cracks and segregations. For example, so-called billets, cogged ingots or round format ingots are produced in continuous casting units and cooled using two-substance nozzles. Due to the numerous different steel qualities and the differing characteristics thereof, and due to the large scope of casting rates, there is need to provide a large nozzle control range for such two-substance nozzles. This means that on the one hand, very major cooling with high volume flow and on the other hand, very gentle cooling with low volume flow should be feasible. If upon a variation of the volume flow and, for example, upon a variation of the water pressure, the jet angle of the two-substance spray nozzles in the secondary cooling would vary as well, then the result thereof could be defects in the produced strands, due to insufficient cooling over the total exterior surface thereof, for example. The two-substance spray nozzle according to the invention overcomes this problem, since even with variable or unsteady water pressures, the jet angle of the output spray jet remains essentially constant. As a result of the varying liquid pressure and/or the varying gas pressure, there is merely a variation in the volume distribution within the spray jet occurring, that is, the distribution of the liquid in the output spray jet. This property can be used intentionally to adjust, by means of variation of the liquid pressure and/or the water pressure, a defined different liquid distribution in the spray jet and thus a different cooling of the cast strand treated thereby. Surprisingly, an essentially constant jet angle can be obtained by means of providing a restrictor on the downstream end of the mixing chamber and of an intermediate chamber between the restrictor and the swirl insert, in a very simple manner. Downstream of the restrictor is a uniform distribution of liquid and gas in the liquid-gas mixture, and segregation is prevented. Due to the restrictor, there is a significant reduction in the pressure dependence of the jet angle observed. The intermediate chamber is dimensioned such that there is no segregation occurring between the restrictor and the swirl insert. By means of the swirl insert, the liquid-gas mixture can be caused to rotate, and downstream of the outlet opening a full cone or a hollow cone may be produced, for example.

In an advanced embodiment of the invention, the restrictor includes a perforated plate.

By means of a perforated plate, a restrictor for the liquid-gas mixture in the mixing chamber can be provided in a very simple manner.

In an advanced embodiment of the invention, the perforated plate exclusively has a plurality of through-holes disposed in the vicinity of the plate periphery.

It was observed that a plurality of through-holes provided exclusively in the vicinity of the periphery of the perforated plate cause a very uniform liquid-gas distribution in the intermediate chamber, and thus the desired independence of the jet angle from liquid pressure and gas pressure is obtained. Therein, the through-holes may be bores disposed at a distance to the periphery, or may even be grooves provided on the periphery of the perforated plate, for example.

In an advanced embodiment of the invention, the restrictor has an orifice including one single, central through-hole.

Such a restrictor can cause a very advantageous liquid-gas distribution in the intermediate chamber, in particular together with a perforated plate.

In an advanced embodiment of the invention, as viewed in the flow direction, the perforated plate is located upstream of the orifice. Advantageously, the orifice is spaced from the perforated plate, as viewed in the flow direction.

As viewed in the flow direction, the orifice may be at a distance to the perforated plate of approximately the radius of the perforated plate. The size of the central through-hole in the orifice is advantageously selected such that the through-hole has a diameter that is smaller than the distance between the through-holes in the perforated plate. In other words, in a projection, the through-holes are completely covered by the orifice.

In an advanced embodiment of the invention, the swirl insert has a plurality of bores or grooves disposed in the peripheral zone or on the outer circumference, wherein the bores or grooves are extending obliquely or helically relative to a central longitudinal axis of the outlet chamber.

In an advanced embodiment of the invention, the swirl insert has a stud protruding into the flow direction and located in the central zone on the downstream side of the insert.

By providing such a stud, the spray characteristic of the two-substance nozzle according to the invention can be varied. Providing such a stud causes generation of a full cone spray jet. With no stud provided on the swirl insert, a hollow cone spray jet is generated. Therein, the stud on the swirl insert is facing the outlet chamber, thus extends in the flow direction. Liquid distribution within the spray jet can be adjusted by the length of the stud. The longer the stud is extended, the more liquid is directed in the center of the jet.

In an advanced embodiment of the invention, the outer circumference of the stud has a non-circular shape.

In an advanced embodiment of the invention, the stud is surrounded by a groove, at least in the vicinity of its end starting from the swirl insert. The groove is annular therein, but advantageously has a non-circular circumference. For example, the groove can be composed of a plurality of adjacent blind holes disposed on a circle. Thus, the blind holes define both the outer circumference of the stud and the outer circumference of the groove.

In an advanced embodiment of the invention, the mixing chamber has a central longitudinal axis, and the at least one liquid inlet leads into the mixing chamber in general tangentially to an imaginary circle around the central longitudinal axis.

By means of tangential feeding of the liquid into the mixing chamber, a very uniform admixing of liquid and gas is achieved already in the mixing chamber. As used herein, the term in general tangentially is to mean perpendicular to the central longitudinal axis, however, not directed in the direction of the restrictor on the downstream end of the mixing chamber, and also not in the opposite direction. Consequently, due to the liquid inlet ending in a generally tangential orientation, the liquid is introduced relative to the central longitudinal axis of the mixing chamber such that the liquid is introduced with a spin around the central longitudinal axis. Thus, the liquid can also be introduced into the mixing chamber obliquely to the tangential direction, that is, obliquely offset in the direction of the central longitudinal axis.

In an advanced embodiment of the invention, at least two liquid inlets are provided, each leading into the mixing chamber in general tangentially to an imaginary circle around the central longitudinal axis, but in opposed directions relative to one another.

In this manner, admixing of liquid and gas in the mixing chamber is further improved.

The object of the invention is also achieved by a method for spraying a liquid-gas mixture using a two-substance nozzle, wherein in a mixing chamber including at least one liquid inlet and at least one gas inlet the liquid-gas mixture is produced, and wherein by means of a swirl insert the liquid-gas mixture is caused to rotate around a central longitudinal axis and is output through an outlet opening, wherein conducting the liquid-gas mixture is provided via a restrictor on the downstream end of the mixing chamber, and conducting the liquid-gas mixture is provided through an intermediate chamber between the restrictor and the swirl insert.

In an advanced embodiment of the invention, variation of a distribution of the liquid-gas mixture in an output spray cone by means of varying a pressure of the gas and/or the liquid is provided, wherein a spray angle of the output spray cone remains essentially constant during a variation of the pressure of the gas and/or the liquid.

In this manner, a distribution of the liquid-gas mixture in the output spray cone can be affected selectively and deliberately, for example, to allow defined variation of a differential cooling of a strand sprayed using the two-substance spray nozzle.

BRIEF DESCRIPTION OF THE DRAWINGS

Further features and advantages of the invention will become apparent from the claims and the following description of preferred embodiments of the invention together with the drawings. Individual features illustrated in the various figures of the drawings may be combined in any arbitrary combination without departing from the scope of the invention.

DETAILED DESCRIPTION

Figure 1:
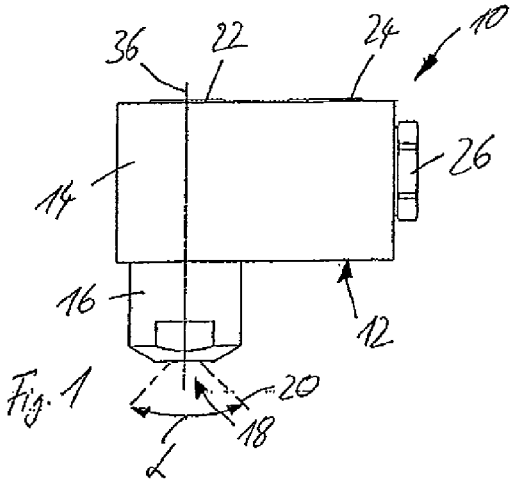
FIG. 1 a side elevation view of a two-substance nozzle according to the invention.

The illustration of FIG. 1 shows a two-substance nozzle 10 according to the invention comprising a nozzle housing 12, wherein the nozzle housing 12 includes a first housing section 14 presenting an essentially rectangular shape, and a short pipe or mouthpiece 16 fixed to the first housing section. Within the mouthpiece 16 an outlet opening 18 (not visible in FIG. 1) is provided to output a spray jet. The spray jet 20 has a cone shape, as illustrated in dashed lines in FIG. 1. The spray jet has a jet angle $\alpha$. A liquid connection 24 for supplying liquid to be sprayed, in particular water, and a pressurized gas connection 22 for supplying pressurized gas, in particular pressurized air, is provided on the first housing section 14. A locking screw 26 is provided on the right hand side of the housing in FIG. 1.

Figure 2:
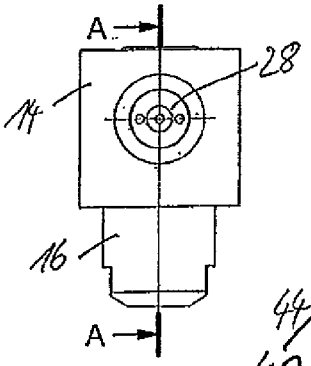
FIG. 2 a side elevation view of the two-substance nozzle of FIG. 1, wherein a locking screw, illustrated on the right hand side in FIG. 1, is removed.

The illustration of FIG. 2 shows the two-substance nozzle of FIG. 1 in a side elevation view, wherein the locking screw 26 is not illustrated. Thus, a liquid inlet part 28 is visible within the first housing section 14, and will be discussed in more detail with reference to FIG. 3 and FIGS. 14 to 17 hereinbelow.

Figure 3:
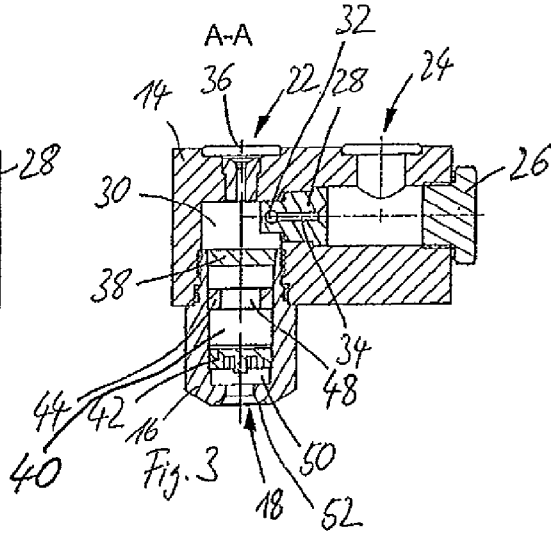
FIG. 3 a view on sectional plane A-A of FIG. 2.

The sectional view of FIG. 3 shows a top view on the sectional plane A-A of FIG. 2. Pressurized gas is fed into the mixing chamber 30 via the pressurized gas connection 22, where the mixing chamber is provided within the first housing section 14. Water to be sprayed is fed into a cross hole of the first housing section 14 via the liquid connection 24 and then as well fed into the mixing chamber 30 via the liquid inlet part 28. An end of the cross hole, located on the right hand side in FIG. 3, is closed by a locking screw 26. The liquid inlet part 28 has two aperture openings 33*a*, 33*b* for liquid, formed by means of a cross hole 32 in a stud protruding into the mixing chamber 30 of the liquid inlet part 28. Said cross hole 32 is visible in the illustrations of FIG. 14 and FIG. 16. Liquid enters into the liquid inlet part 28 via a longitudinal hole 31 to then impact onto the cross hole 32 in a perpendicular orientation. Thereby, the liquid is deflected within the liquid inlet part by 90° of angle, exits the liquid inlet part via the two aperture openings 33*a*, 33*b* of the cross hole 32, and thus enters the mixing chamber 30 in an approximately tangential orientation. Therein, only the center of the cross hole 32 is strictly tangential, the ends of the cross hole issue outwards offset relative to the tangential direction of the aperture openings 33*a*, 33*b*. As is illustrated in FIG. 3, the gas jet entering via the pressurized gas connection 22 and the liquid entering via the liquid inlet part 28 do not converge immediately. The liquid is introduced into the mixing chamber 30 through the cross hole 32 in general approximately tangentially in two opposed directions. The result thereof is proper and uniform admixing of liquid and gas within the mixing chamber 30.

Figure 8:
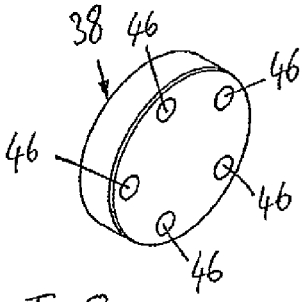
FIG. 8 an oblique view from above on a perforated plate of the two-substance nozzle of FIG. 1.
Figure 9:
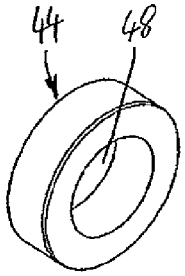
FIG. 9 an oblique view from above on an orifice of the two-substance nozzle of FIG. 1.

Starting from the mixing chamber 30, the liquid-gas mixture is then transferred into an intermediate chamber 40 thereby passing a perforated plate 38. The intermediate chamber 40 extends between the perforated plate 38 and a swirl insert 42. An orifice 44 is disposed within the intermediate chamber. In the embodiment as illustrated, the perforated plate includes a total of five through-holes 46, visible in the illustration of the perforated plate 38 in FIG. 8. Therein, the through-holes 46 are arranged at uniform intervals one from the other on a circle that is concentric to the central longitudinal axis 36. The through-holes 46 are disposed in the vicinity of a peripheral zone of the perforated plate 38. The perforated plate 38 does not include any further perforations or passages in addition to the through-holes 46. Thereby, the liquid from the mixing chamber 30 is enabled to enter the intermediate chamber 40 only via the through-holes 46.

The orifice 44 includes but one through-hole 48 disposed concentric to the central longitudinal axis and designed in an annular shape. A diameter of the through-hole 48 in the orifice 44 is dimensioned such that in a projection along the central longitudinal axis 36, the through-holes 46 in the perforated plate 38 are covered by the orifice 44.

Thus, the liquid-gas mixture entering into the intermediate chamber 40 via the through-holes 46 of the perforated plate 38 is deflected by means of the orifice 44 and led in the through-hole 48 of the orifice 44. The perforated plate 38 and the orifice 44 constitute a restrictor for the liquid-gas mixture.

Downstream of the orifice 44, the diameter of the intermediate chamber 40 is again enlarging and the liquid-gas mixture is led up to the swirl insert 42. By means of the swirl insert 42 the liquid-gas mixture is moved into a spin around the central longitudinal axis 36 and then enters an outlet chamber 50, where an outlet opening 18 is disposed on the downstream end of said chamber. The outlet opening 18 has a cylindrical section starting from the outlet chamber 50 and a conical flaring section adjoining the cylindrical section, as viewed in the flow direction. The outlet opening 18 is provided in the short pipe or mouthpiece 16, and concentrically surrounded by a drainage area or drop edge 52.

Figure 7:
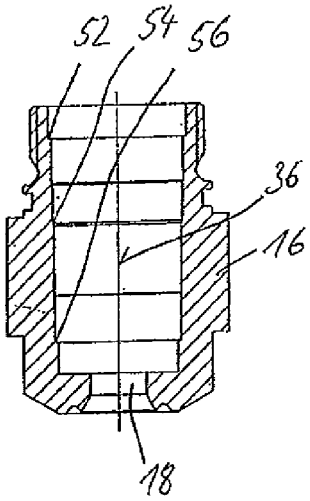
FIG. 7 a sectional view of a short pipe of the two-substance nozzle of FIG. 1.

The perforated plate 38 is provided on an end of the mouthpiece that is screwed into the first housing section 14, and the orifice 44 and the swirl insert 42 are also disposed in the mouthpiece 16. The mouthpiece 16, cf. FIG. 7, is provided with a plurality of steps, each matched to the diameter of the perforated plate 38, the orifice 44 and the swirl insert 42, respectively. Towards the direction of the outlet opening 18, an inner diameter of the mouthpiece 16 becomes smaller. As viewed in the flow direction, the perforated plate 38 is disposed on a first circumferential step 52. The orifice 44 is disposed on a second circumferential step 54, and the swirl insert 42 is disposed on a third circumferential step 56. Since the inner diameter of the mouthpiece 16 decreases from the first step 52 to the third step 56, the swirl insert 42, the orifice 44 and the perforated plate 38 can be inserted subsequently into the mouthpiece 16 without difficulties, and assume a defined position within the mouthpiece 16 due to the circumferential steps 56, 54, and 52, respectively. There is an interior space of the mouthpiece 16 essentially in a cylindrical shape designed between the circumferential steps 52, 54, 56. Therein, additional narrower circumferential steps can be provided, each on the level of a surface of the orifice 44 and the swirl insert 42 facing the flow.

Figure 4:
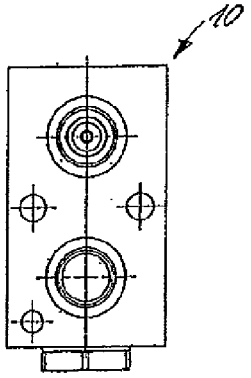
FIG. 4 a top view on the two-substance nozzle of FIG. 1.
Figure 5:
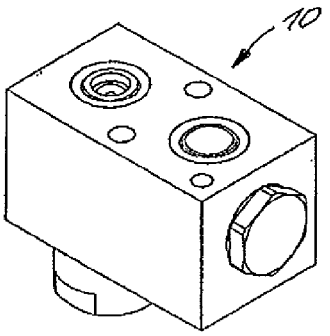
FIG. 5 an oblique view from above on the two-substance nozzle of FIG. 1.

The illustration of FIG. 4 shows a top view on the two-substance nozzle 10, and FIG. 5 shows an oblique view from above on the two-substance nozzle 10.

Figure 6:
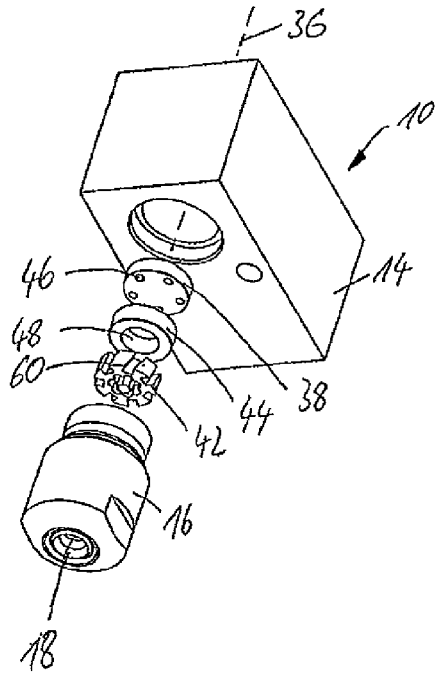
FIG. 6 an expanded illustration of the two-substance nozzle of FIG. 1.

FIG. 6 shows the two-substance nozzle 10 in an expanded view. After inserting the swirl insert 42, the orifice 44 and the perforated plate 38 into the short pipe 16, said pipe is screwed into the first housing section 14. FIG. 6 reveals that the liquid-gas mixture leaving the mixing chamber 30 at first and exclusively has to pass the through-holes 46 in the perforated plate 38, and then is deflected into the central through-hole 48 of the orifice 44. Downstream of the through-hole 48, the liquid-gas mixture is again allowed to spread radially outwards, and then enters into the outlet chamber 50 via swirl ducts 60 on the outer circumference of the swirl insert 42, to then be output via the outlet opening 18 as a spray cone. The swirl ducts 60 are arranged on the outer circumference of the swirl insert 42, spaced at uniform intervals one from the other, and disposed obliquely to the central longitudinal axis 36. Thereby, due to the swirl insert 42 the liquid-gas mixture is given a spin around the central longitudinal axis 36, and as a consequence exits through the outlet opening 18 disposed concentrically to the central longitudinal axis 36, and forms the spray jet 20 downstream of the outlet opening 18, cf. FIG. 1.

By providing a restrictor downstream of the mixing chamber 30, which in the embodiment as illustrated is constituted by the perforated plate 38 and the orifice 44 disposed at a distance from the perforated plate 38, the two-substance nozzle 10 is adapted to allow a jet angle $\alpha$ of the spray cone 20 that is essentially independent of the pressure of the gas supplied and the liquid supplied, cf. FIG. 1. In any case, the spray nozzle 10 according to the invention permits to achieve an essentially constant jet angle $\alpha$ over a wide range of pressure of the liquid and pressure of the gas. Therein, a restrictor can be constituted merely by means of the perforated plate 38, if the orifice 44 is omitted.

Typically, the spray angle is essentially constant at a water pressure between 4 bar and 8 bar and an air pressure of 1 bar. With an air pressure of 2 bar, the jet angle varies upon variation of the water pressure between 4 bar and 8 bar only by somewhat less than 10°. However, upon a variation of the water pressure, there is variation of a distribution of the liquid-gas mixture within the spray cone 20. Indeed, with increasing air pressure, there is more liquid-gas mixture located in the center of the spray cone 20. While, with increasing water pressure, there is less liquid-gas mixture located in the central zone of the spray cone 20 around the central longitudinal axis 36. Using the two-substance nozzle 10 according to the invention, aimed control of a liquid distribution and distribution of the liquid-gas mixture within the spray cone 20, respectively, is feasible.

Figure 10:
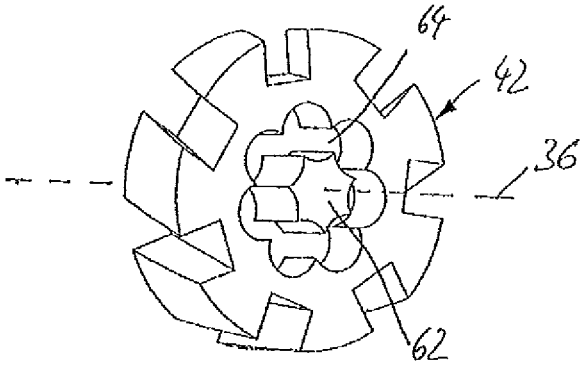
FIG. 10 an oblique view from above on a swirl insert of the two-substance nozzle of FIG. 1.

The illustration of FIG. 10 shows the swirl insert 42 in an oblique front view. The grooves disposed on the outer circumference of the swirl insert 42 and extending obliquely relative to the central longitudinal axis 36 are revealed. On the side facing away from the flow, cf. FIG. 3, the swirl insert 42 is provided with a stud 62 disposed concentric to the central longitudinal axis. The stud protrudes beyond a bottom of the swirl insert 42, cf. FIG. 3. An outer circumference of the stud 62 has a non-circular shape. In the vicinity of the base point of the stud 62 on the swirl insert 42, the stud is surrounded by a circumferential groove 64. The groove is formed by driving a plurality of blind holes into the swirl insert 42 parallel to the central longitudinal axis. In the embodiment as illustrated, there are a total of seven blind holes driven into the swirl insert 42 in parallel to the central longitudinal axis 36. Thus, an outer circumference of the groove 64 is composed of a total of seven segments of circle. The centers of the blind holes are located on a circle that is concentrically surrounding the central longitudinal axis 36, cf. FIG. 12. A distribution of the liquid-gas mixture in the spray cone 20 can be controlled via the length of the stud 62. If the stud 62 is omitted and the surface of the swirl insert 42 facing away from the flow is planar, the spray cone 20 will be in the shape of a hollow cone. Providing the stud 62 causes formation of the spray jet 20 in the shape of a full cone.

Figure 11:
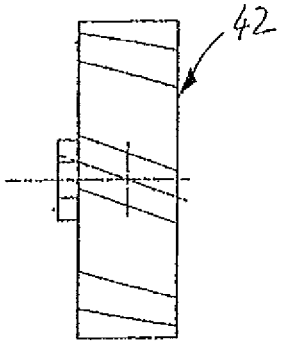
FIG. 11 a side elevation view of the swirl insert of FIG. 10.
Figure 12:
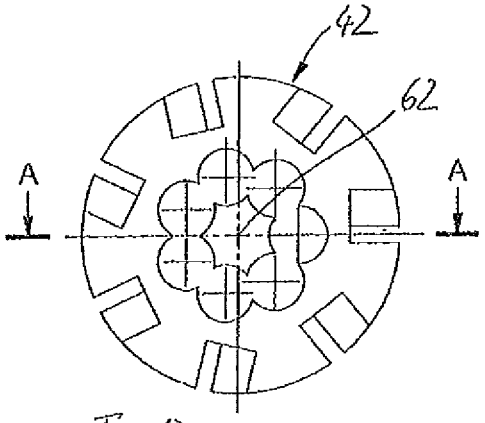
FIG. 12 a top view on the swirl insert of FIG. 10.
Figure 13:
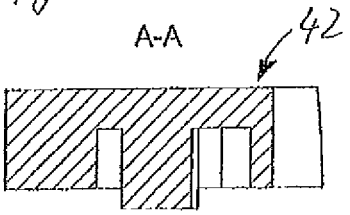
FIG. 13 a sectional view on the sectional plane A-A of FIG. 12.
Figure 14:
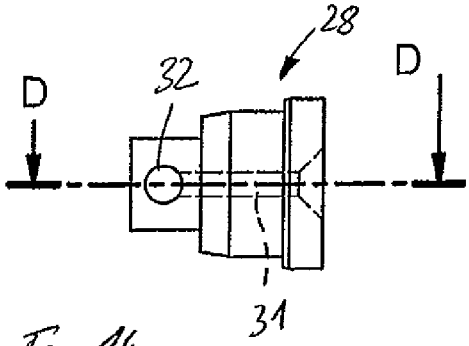
FIG. 14 a side elevation view of a liquid inlet part of the two-substance nozzle of FIG. 1.
Figure 15:
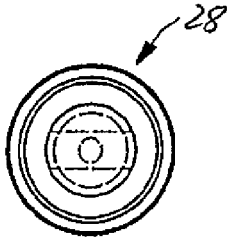
FIG. 15 a front view of the liquid inlet part of FIG. 14.
Figure 16:
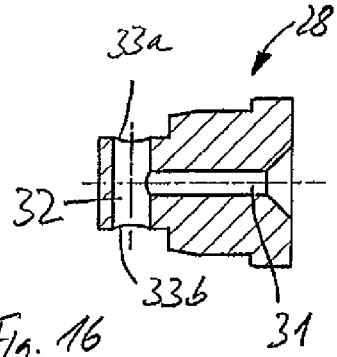
FIG. 16 a view on the sectional plane D-D.
Figure 17:
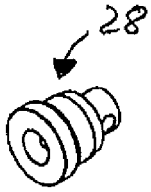
FIG. 17 an oblique view from above on the liquid inlet part of FIG. 14.
Figure 18:
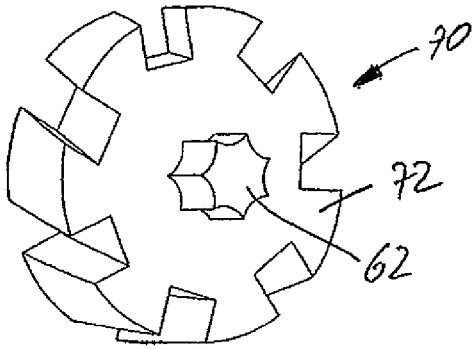
FIG. 18 an oblique front view of a swirl insert for a two-substance nozzle according to the invention in a second embodiment.
Figure 19:
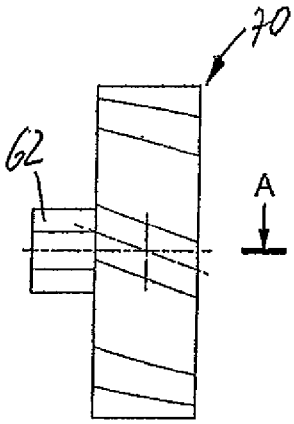
FIG. 19 a side elevation view of the swirl insert of FIG. 18.
Figure 20:
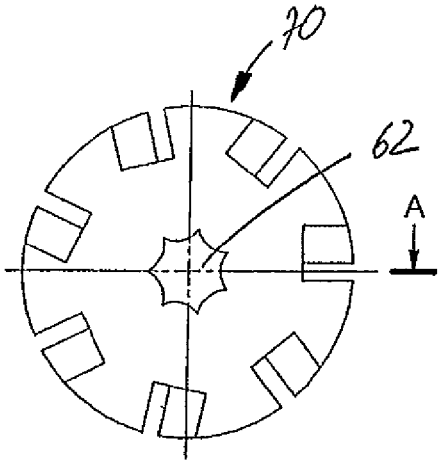
FIG. 20 a front view of the swirl insert of FIG. 18.
Figure 21:
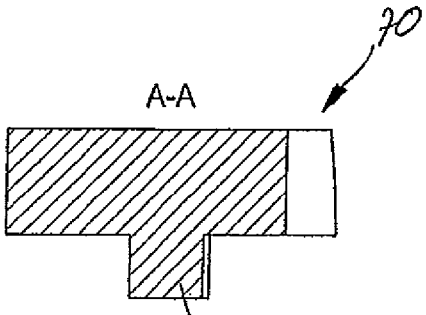
FIG. 21 a view on the sectional plane A-A in FIG. 20.

The illustrations of FIGS. 11, 12 and 13 show further views of the swirl insert 42.

The illustrations of FIGS. 18 through 21 show a swirl insert 70, modified as compared to the swirl insert 42 of FIG. 10 through 13, but intended to be employed on the same position in the two-substance nozzle 10 of FIG. 1 according to the invention. The differences to the swirl insert 42 of FIGS. 12 and 13 will be discussed below.

As distinguished from the swirl insert 42, the swirl insert 70 does not include the groove 64 surrounding the stud 62. Thus, the stud 62 is disposed on a planar surface 72 of the swirl insert, wherein the surface 72 is located on the downstream side of the swirl insert, in the installed condition of the swirl insert, cf. FIG. 3. The stud 62 as such has a non-circular shape, as with the swirl insert 42, the stud circumference being constituted by mutually adjoining concave partial surfaces of a circular cylinder. In total, the circumference of the stud 62 is formed by seven mutually adjoining partial circular cylindrical surfaces. The grooves extending obliquely relative to the flow direction on the circumference of the swirl insert 70 are identical to the grooves on the swirl insert 42. As with the swirl insert 42, a total of seven obliquely extending grooves are provided on the outer circumference.

Figure 22:
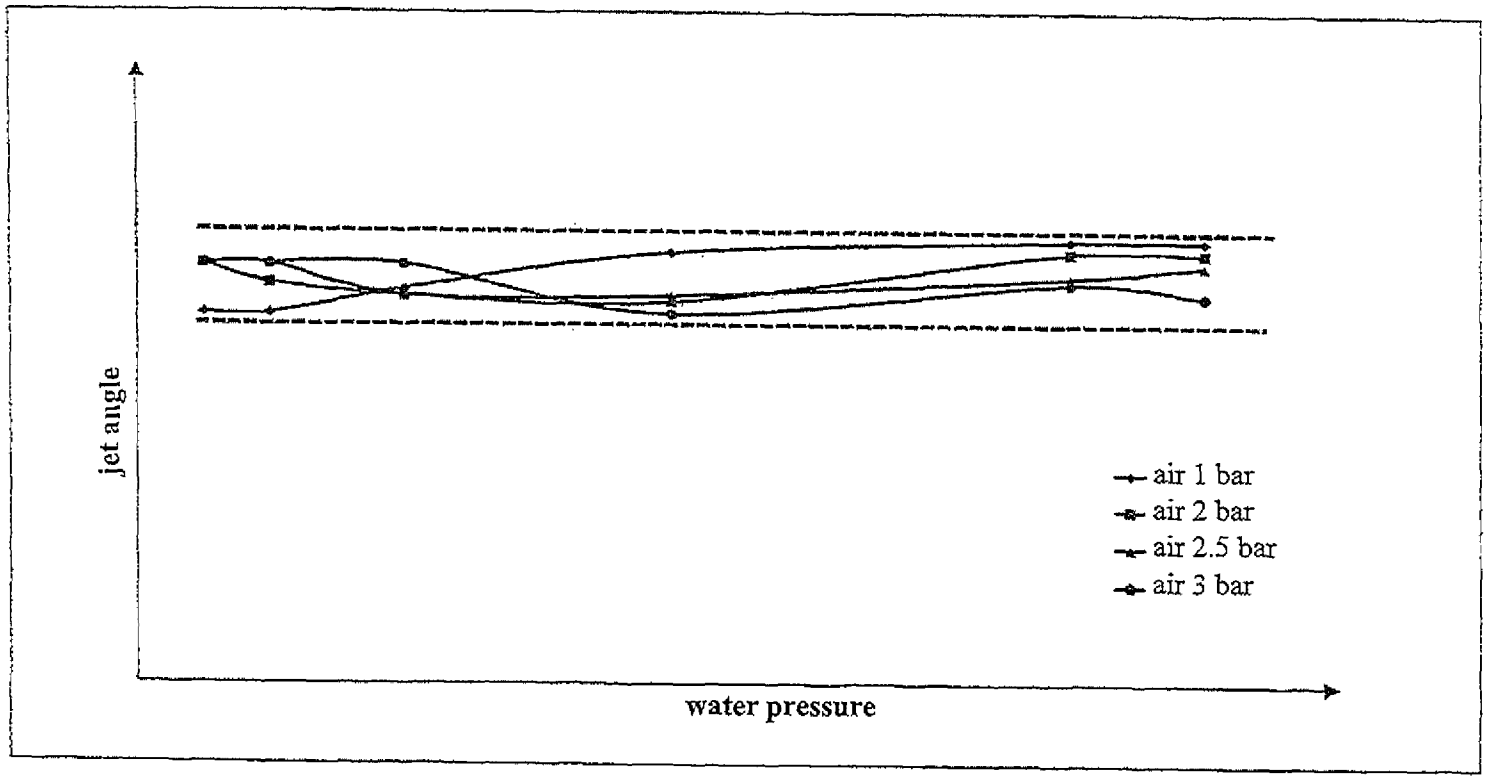
FIG. 22 an illustration of the variation of the jet angle of the two-substance nozzle according to the invention in FIG. 1 as a function of water pressure.

The illustration of FIG. 22 shows a total of four curves to depict the variation of the jet angle of the two-substance nozzle according to the invention in FIG. 1 with varying water pressure. The different curves correspond to different air pressures. The curve denoted by a diamond depicts the variation of the jet angle at an air pressure of 1 bar, the curve denoted by a square the variation of the jet angle at an air pressure of 2 bar, the curve denoted by a triangle the variation of the jet angle at an air pressure of 2.5 bar, and the curve denoted by circles the variation of the jet angle at an air pressure of 3 bar.

It is revealed that upon a variation of the water pressure, the jet angle varies within a comparatively narrow range independent of the air pressure. Thus, the two-substance nozzle according to the invention is not susceptible to variations of the water pressure, as far as the jet angle is concerned.

Figure 23:
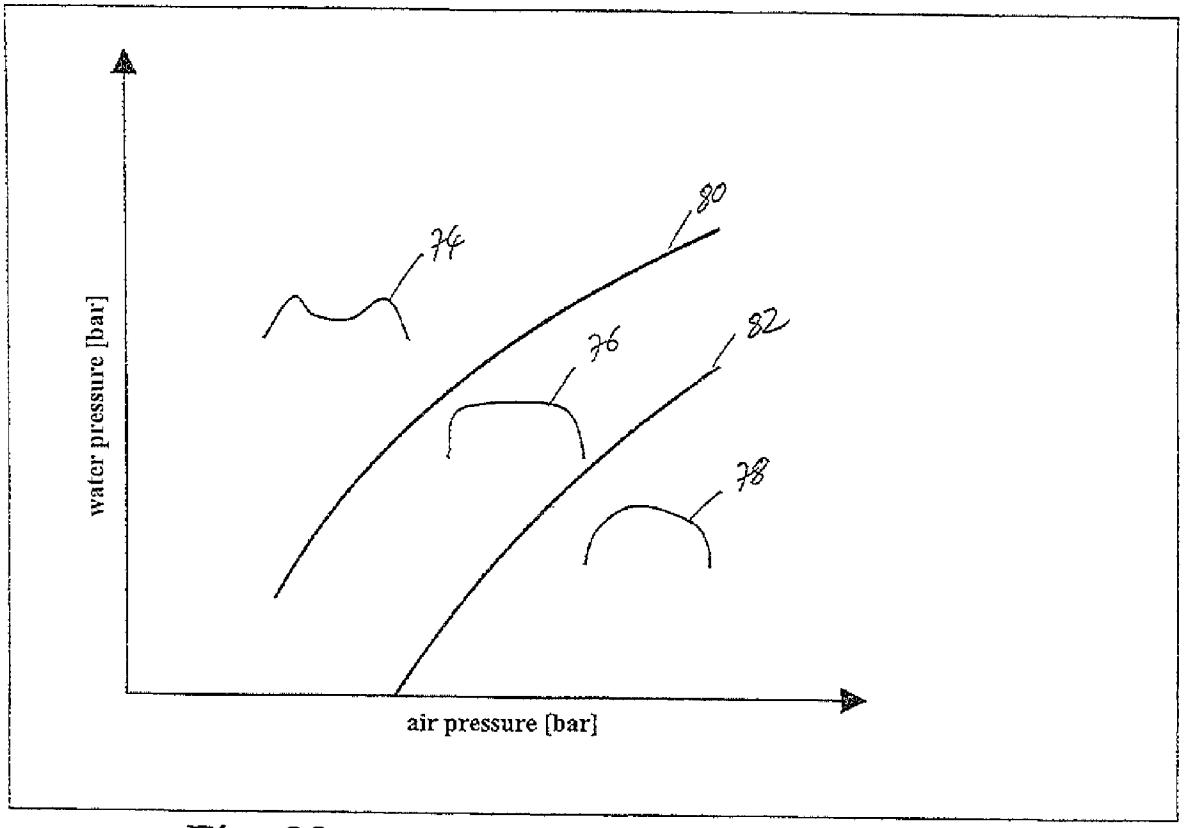
FIG. 23 an illustration of the variation of the water distribution within the spray jet produced by the two-substance nozzle according to the invention in FIG. 1 as a function of water pressure and air pressure.

The illustration of FIG. 23 shows the qualitative variation of the water distribution within the spray jet of the two-substance nozzle according to the invention in FIG. 1 at variable air pressure and water pressure, respectively, in a diagrammatic graph. The reference numerals 74, 76 and 78 designate different water distributions within the spray jet, and what is revealed is that with increasing air pressure, there is more liquid in the center of the jet. The water distributions 74, 76 and 78 are in total approximately axially symmetric around the center axis of the spray jet.

As depicted in FIG. 23, with increasing water pressure, starting from the water distribution 78, there is at first the water distribution 76 and then the water distribution 74 occurring. With increasing air pressure, there is at first the water distribution 74, then the water distribution 76, and finally the water distribution 78 occurring. The lines 80 and 82 designate approximate parting lines between the individual ranges of different water distributions 74, 76 and 78, respectively.

Consequently, the two-substance nozzle according to the invention allows adjustment of a desired water distribution by means of an adjustment of the water pressure and/or the air pressure at an essentially constant jet angle. In this manner, long products in a continuous casting unit may be subject to different cooling regimes by varying the water pressure and/or the air pressure of the two-substance nozzle according to the invention.

The invention claimed is:

1. A two-substance nozzle for spraying a liquid-gas mixture, comprising a nozzle housing including at least one liquid inlet leading into a mixing chamber and at least one gas inlet leading into the mixing chamber, a swirl insert, an outlet chamber between the swirl insert and an outlet opening on the downstream end of the outlet chamber, a restrictor on the downstream end of the mixing chamber, and an intermediate chamber between the restrictor and the swirl insert, wherein an outlet channel formed by the outlet opening is shorter than the mixing chamber, as viewed in an outflow direction, and wherein the mixing chamber has a central longitudinal axis, and the at least one liquid inlet leads into the mixing chamber approximately tangentially to an imaginary circle around the central longitudinal axis.

2. The two-substance nozzle according to claim 1, wherein the restrictor includes a perforated plate.

3. The two-substance nozzle according to claim 2, wherein the perforated plate has a plurality of through-holes, all of the plurality of through-holes being disposed adjacent a periphery of the perforated plate.

4. The two-substance nozzle according to claim 1, wherein the restrictor has an orifice including one single, central through-hole.

5. The two-substance nozzle according to claim 1, wherein the restrictor has at least one perforated plate including a plurality of through-holes disposed adjacent a periphery of the perforated plate and at least one orifice including one single, central through-hole.

6. The two-substance nozzle according to claim 5, wherein, as viewed in the outflow direction, the perforated plate is located upstream of the orifice.

7. The two-substance nozzle according to claim 6, wherein, as viewed in the outflow direction, the orifice is spaced from the perforated plate.

8. The two-substance nozzle according to claim 1, wherein the swirl insert includes a plurality of bores disposed in a peripheral zone of the swirl insert or grooves disposed on an outer circumference of the swirl insert, wherein the bores or grooves extend obliquely or helically relative to a central longitudinal axis of the outlet chamber.

9. The two-substance nozzle according to claim 1, wherein the swirl insert includes a stud protruding into the outflow direction and located in a central zone on a downstream side of the swirl insert.

10. The two-substance nozzle according to claim 9, wherein the stud is surrounded by a groove formed in the swirl insert.

11. The two-substance nozzle according to claim 1, wherein at least two liquid inlets are provided, each leading into the mixing chamber approximately tangentially to the imaginary circle around the central longitudinal axis, but in opposed directions relative to one another.

* * * * *